United States Patent [19]

Oshizawa et al.

[11] Patent Number: 4,620,260

[45] Date of Patent: Oct. 28, 1986

[54] CIRCUIT FOR DRIVING SOLENOID

[75] Inventors: Hidekazu Oshizawa; Takeo Kushida, both of Higashimatsuyama, Japan

[73] Assignee: Diesel Kiki Co., Ltd., Japan

[21] Appl. No.: 683,717

[22] Filed: Dec. 19, 1984

[30] Foreign Application Priority Data

Dec. 20, 1983 [JP] Japan ..... 58-238931

[51] Int. Cl.[4] ..... H01H 47/32

[52] U.S. Cl. ..... 361/152; 361/160

[58] Field of Search ..... 361/152, 153, 154, 160, 361/194

[56] References Cited

U.S. PATENT DOCUMENTS 3,149,244 9/1964 Barnes et al. ..... 361/152 X

*Primary Examiner*—Michael L. Gellner

*Attorney, Agent, or Firm*—Guy W. Shoup

[57] ABSTRACT

A solenoid driving circuit for supplying an exciting current whose level suddenly increases at the beginning of the flow of the current has a voltage inducing circuit for providing a pulse-like current component which suddenly increases at the beginning of the flow of the exciting current, a unidirectional element for supplying the pulse-like current component to the solenoid and a voltage limiting element for limiting the level of the pulse-like current component and applying a d.c. power to the solenoid, whereby the solenoid is effectively supplied with sufficient energy for driving it at high speed.

5 Claims, 6 Drawing Figures

FIG. 1
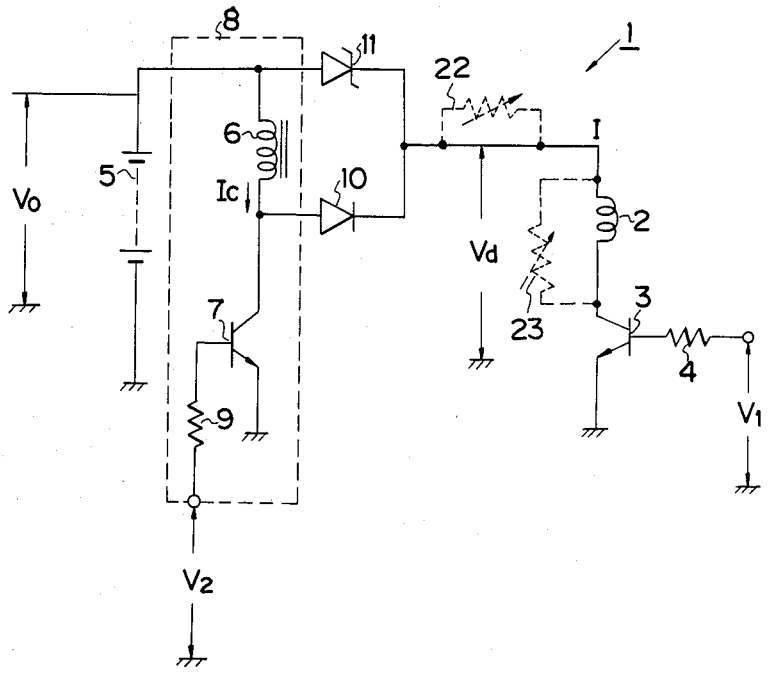
FIG. 2A
FIG. 2B
FIG. 2C
FIG. 2D
FIG. 2E
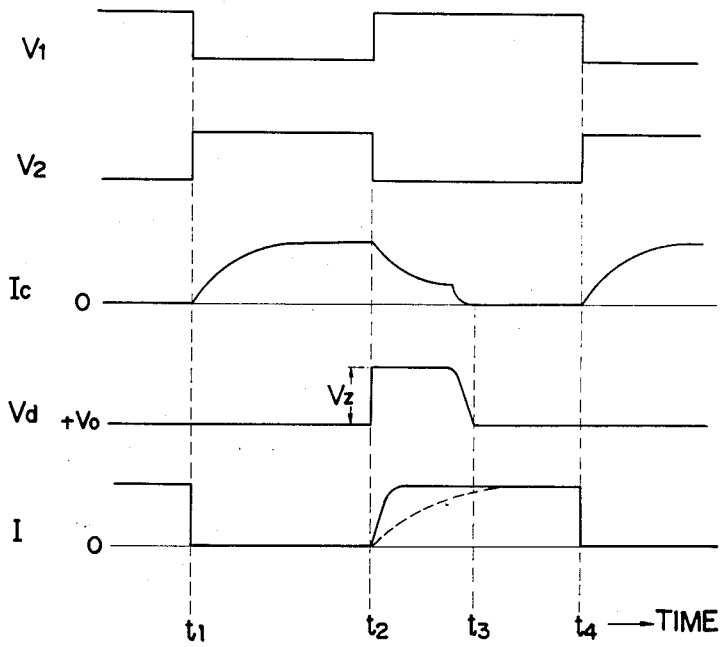

CIRCUIT FOR DRIVING SOLENOID

BACKGROUND OF THE INVENTION

1. Field of the Invention

The present invention relates to a circuit for driving a solenoid, and more particularly to a solenoid driving circuit for driving solenoids used in solenoid valves, solenoid relays and the like at high speed.

2. Description of the Prior Art

For high speed operation of solenoids, there have been proposed various kinds of circuits for supplying a counterelectromotive force suddenly produced when the current flowing through a choke coil is cut off as the exciting current for the solenoid.

As such a circuit, there is disclosed for example in Japanese Patent Public Disclosure No. 61106/81 an electromagnet driving circuit in which a series circuit of a choke coil and a first switch is connected in parallel with a d.c. power source, one end of the solenoid to be driven is connected with both ends of the choke coil through diodes, and the other end of the solenoid is connected through a switch with one end portion of the d.c. power source.

In this electromagnet driving circuit, the first switch is normally closed so that a steady current is supplied to the solenoid from the d.c. power source through the choke coil, and the switch is normally open. In this condition, when the switch is closed at the same time the first switch is opened, a large counterelectromotive force due to electromagnetic induction is produced in the choke coil. The voltage due to the counterelectromotive force is superposed on the voltage of the d.c. power source to make it possible to provide a suddenly standing-up exciting current to the solenoid.

However, the waveform of the exciting voltage supplied to the solenoid by the conventional driving circuit is extremely sharp, has a large peak value, and is extremely narrow in width. Therefore, with respect to other nearby electronic equipment, it constitutes a high level noise source. Furthermore, the efficiency of the circuit is low since most of the energy is used for the production of noise, and the service life of the switches is short due to the voltage with an extremely large peak value. The efficiency of the circuit is also low since the exciting energy is provided only for a short time. Also, when semiconductor switching elements are used for the switches, it is necessary to use expensive elements which can withstand very high voltage since a voltage with an extremely large peak value is produced in this circuit.

SUMMARY OF THE INVENTION

It is therefore an object of the present invention to provide an improved solenoid driving circuit which is capable of eliminating these drawbacks of the conventional circuit.

It is another object of the present invention to provide a solenoid driving circuit which is capable of effectively supplying the counterelectromotive force produced in the choke coil to the solenoid to be driven and remarkably reducing the production of electromagnetic noise.

According to the present invention, in a solenoid driving circuit for providing an exciting current which suddenly stands up to a solenoid in order to operate the solenoid at high speed, the solenoid driving circuit has a d.c. power source, a first switch connected in series with the solenoid for passing or cutting off the exciting current supplied to the solenoid, a series circuit for producing a counterelectromotive force, the series circuit being composed of a choke coil and a second switch which is switched from its ON state to its OFF state when the first switch is switched from its OFF state to its ON state, a unidirectional element connected between one end of the choke coil and the solenoid in order to apply to the solenoid a counterelectromotive force produced in the choke coil and a voltage limiting element for limiting the level of the transient voltage applied to the solenoid through the unidirectional element and for applying the voltage of the d.c. power source to said solenoid coil, the voltage limiting element being connected between the solenoid and the d.c. power source.

With this structure, since the peak value of the transient voltage produced by the series circuit is limited by a voltage limiting element such as a zener diode, the occurrence of electromagnetic noise can be remarkably reduced and the transient voltage can be maintained for a longer period than in conventional circuits of this type. Therefore, it becomes possible to provide sufficient energy for making the leading edge of the exciting current at the start of the driving of the solenoid sharp, and to realize high speed operation of the solenoid.

The invention will be better understood and the other objects and advantages thereof will be more apparent from the following detailed description of a preferred embodiment with reference to the accompanying drawings.

BRIEF DESCRIPTION OF THE DRAWINGS

FIG. 1 is a circuit diagram of an embodiment of a solenoid driving circuit of the present invention; and FIGS. 2A to 2E are the waveforms of signals at respective points of the circuit of FIG. 1.

DESCRIPTION OF THE PREFERRED EMBODIMENTS

FIG. 1 shows an embodiment of a solenoid driving circuit of the present invention. A solenoid driving circuit 1 has a transistor 3 as a switching element for ON/OFF controlling an exciting current I flowing through a solenoid coil 2 and a control voltage $V_1$ is applied through a resistor 4 to the base of the transistor 3. The solenoid coil 2 may be the exciting coil of a solenoid valve, a solenoid relay or the like.

A voltage inducing circuit 8 for generating a counterelectromotive force is formed by connecting a choke coil 6 in series with a switching transistor 7 and the voltage inducing circuit 8 is connected in parallel with a d.c. power source 5 for supplying an exciting current to the solenoid coil 2. The transistor 7 is controlled so as to be turned ON or OFF in accordance with the level of a control voltage $V_2$ which is applied through a resistor 9 to the base thereof. The control voltages $V_1$ and $V_2$ are produced by a control circuit (not shown) so as to turn OFF the transistor 7 when the transistor 3 is turned ON. Consequently, in response to the control voltages $V_1$ and $V_2$, the transistor 7 is turned ON when the transistor 3 is turned OFF.

A steady current flows through the choke coil 6 when the transistor 7 is ON, and a counterelectromotive force due to electromagnet induction is produced in the choke coil 6 when the transistor 7 is turned OFF at the same time the transistor 3 is turned ON.

To apply the terminal voltage $V_0$ of the d.c. power source 5 and the voltage which is momentarily produced by the counterelectromotive force developed across the choke coil 6 to the solenoid coil Z, as shown in FIG. 1, a zener diode 11 is connected between the positive terminal of the d.c. power source 5 and the solenoid coil 2, and a diode 10 is connected between the collector of the transistor 7 and the solenoid coil 2. As a result, the terminal voltage $V_0$ is supplied through the zener diode 11 to the one end of the solenoid coil Z. Then, when the counterelectromotive force is developed across the choke coil 6, the resulting transient voltage is supplied through the diode 10 to the same end of the solenoid coil 2. In this case, the zener diode 11 also acts as a voltage limiting element for suppressing the level of the voltage developed due to the counterelectromotive force to below a predetermined level, whereby the voltage developed due to the counterelectromotive force can effectively be applied to the solenoid coil 2.

The operation of the solenoid driving circuit 1 of FIG. 1 will be now described with reference to FIGS. 2A to 2E. When the level of the control voltage $V_1$ becomes low and the level of the control voltage $V_2$ becomes high at the time $t_1$ (FIGS. 2A and 2B), the transistor 3 is turned OFF and the transistor 7 is turned ON. Therefore, as shown in FIG. 2C, the level of the current $I_c$ flowing through the choke coil 6 increases in accordance with a predetermined time constant after the time $t_1$ until it reaches a steady state level. Since the voltage $V_0$ is applied through the zener diode 11 to the one end of the solenoid coil 2, the value of the voltage $V_d$ is equal to the voltage $V_0$ at this time. For simplicity of explanation, the voltage drops across the zener diode 11 is neglected. Since the transistor 3 is in OFF state, the exciting current I is zero regardless of the application of the voltage $V_d$.

When the levels of the control voltages $V_1$ and $V_2$ are respectively inverted at the time $t_2$, the transistor 7 is turned OFF at the same time the transistor 3 is turned ON. As a result, the level of the current $I_c$ decreases in accordance with a predetermined characteristic curve (FIG. 2C), and a counterelectromotive force due to electromagnetic induction is developed across the choke coil 6. The transient voltage produced by the counterelectromotive force is supplied through the diode 10 to the solenoid coil 2, so that the magnitude of the voltage $V_d$ is increased by the addition of the transient voltage described above to the voltage $V_0$.

The maximum value of the transient voltage is, however, suppressed to less than a predetermined value $V_z$, which depends upon the zener characteristic of the zener diode 11 (FIG. 2D). The level of the transient voltage becomes zero at the time $t_3$ and the level of the voltage $V_d$ becomes equal to that of the voltage $V_0$ at the time $t_3$. When the maximum level of the transient voltage is suppressed by the zener diode 11 as described above, the electromagnetic interference to other electronic equipment can be remarkably reduced and the efficiency of the circuit is increased due to the suppression of noise energy. Moreover, the width of the pulse-like voltage superposed on the voltage $V_0$ becomes wider and the leading edge of the exciting current I becomes sharper (FIG. 2E) to make it possible to operate the solenoid at high speed. By way of comparison, the poor standing-up characteristic of the exciting current that would be obtained if only the voltage $V_0$ should be applied at the time $t_2$ is shown by a broken line in FIG. 2E.

When the level of the control voltage $V_1$ becomes low while the level of the control voltage $V_2$ becomes high at the time $t_4$, the solenoid coil 2 is deenergized since the transistor 3 is turned OFF. At this time, the transistor 7 is turned ON so that the steady current starts to flow through the choke coil 6 again.

Though the output voltage $V_d$ from the voltage inducing circuit 8 is directly applied to the solenoid coil Z in the embodiment shown in FIG. 1, as shown by the broken line in FIG. 1, a current limiting variable resistor 22 may be connected in series with the solenoid coil Z as an attenuating means to appropriately adjust the magnitude of the exciting current I. Alternatively, in place of the current limiting resistor 22, a variable resistor 23 may be provided in parallel to the solenoid coil 2 as shown by the broken line in FIG. 1 in order to control the supply of the counterelectromotive force to the solenoid coil 2.

We claim:

1. A circuit for driving a solenoid, which provides a suddenly standing-up exciting current to the solenoid in order to operate the solenoid at high speed, said circuit comprising:

a d.c. power source;

a first switch connected in series with the solenoid for passing or cutting off the exciting current supplied to the solenoid;

a series circuit composed of a choke coil and a second switch which is switched from its ON state to its OFF state when the first switch is switched from its 0FF state to its ON state, said series circuit being connected with said d.c. power source, whereby to produce a counterelectromotive force;

a unidirectional element connected between one end of the choke coil and the solenoid in order to apply to the solenoid the counterelectromotive force produced in the choke coil; and a voltage limiting element for limiting the level of the transient voltage applied through the unidirectional element to the solenoid and for applying the voltage of the d.c. power source to said solenoid coil, the voltage limiting element being connected between the solenoid and the d.c. power source.

2. A circuit as claimed in claim 1 wherein said voltage limiting element is a zener diode.

3. A circuit as claimed in claim 1 wherein said unidirectional element is a diode.

4. A circuit as claimed in claim 1 wherein said first and second switches are semiconductor switching means.

5. A circuit as claimed in claim 1, further comprising an attenuating means for attenuating the level of the exciting current supplied to the solenoid.

* * * * *